United States Patent [19]

Lin

[11] Patent Number: 4,854,859

[45] Date of Patent: Aug. 8, 1989

[54] ADJUSTMENT AND POSITIONING STRUCTURE OF THE ELONGATED ROD-LIKE LIGHTER

[76] Inventor: Anderson Lin, 8 Alley 9, Lane 82, Pa Teh Road, Sec. 1, Taipei, Taiwan

[21] Appl. No.: 91,958

[22] Filed: Sep. 1, 1987

[51] Int. Cl.[4] ..... F23D 14/28

[52] U.S. Cl. ..... 431/344; 431/144; 431/277

[58] Field of Search ..... 431/255, 344, 345, 277, 431/144, 142, 253, 156, 202, 276, 254

[56] References Cited

U.S. PATENT DOCUMENTS

| | | | |
|---|---|---|---|
| 3,495,414 | 2/1970 | Fassbender | 431/344 |
| 3,955,913 | 5/1976 | Benzaria | 431/344 |
| 3,989,445 | 11/1976 | Kojima | 431/344 |
| 4,042,316 | 8/1977 | Rabe | 431/344 |
| 4,222,734 | 9/1980 | Nolf | 431/344 |

*Primary Examiner*—James C. Yeung

*Attorney, Agent, or Firm*—Wenderoth, Lind & Ponack

[57] ABSTRACT

An elongated rod-like gas lighter has a rod body for storing gas therein, an ignition base mounted on the upper end of the rod body, the ignition base having a circumferential groove-shaped hole through the wall thereof adjacent the point of attachment to the rod body, a gas adjustment ring rotatably mounted around the ignition base and movably engaged with the upper end of the rod body and having a threaded hole radially therethrough and a gas supply adjusting screw therein extending through the circumferential groove-shaped hole, a gas nozzle tube within the ignition base having the upper end extending upwardly out of the ignition base, and a rotatably operable gas flow adjusting valve on the upper end of the rod body and receiving the lower end of the gas nozzle tube, the gas supply adjusting screw being engaged with the outside of the gas flow adjusting valve for rotating the gas flow adjusting valve when the gas adjusting ring is rotated on the ignition base.

3 Claims, 2 Drawing Sheets

ADJUSTMENT AND POSITIONING STRUCTURE OF THE ELONGATED ROD-LIKE LIGHTER

FIELD OF THE INVENTION

An improved adjustment and positioning structure of an elongated rod-like lighter has a feature that a gas adjustment ring is provided between the rod body and the housing cover to conveniently regulate the gas supply, and a fixing ring is provided between the lighting base and the rod body to join the lighting base and rod body tightly together in a single integral unit to avoid their slipping off which may otherwise cause gas leakage.

BACKGROUND OF THE INVENTION

In the structure (as shown in FIG. 1) of conventional elongated rod-light lighters (for ignition of candle pedestals or stoves, ovens), its ignition base A has threads B provided on the bottom, and an air-tight sealing ring C is sleeved thereon, the threads B and rod body D are screwed together, an ignition wheel E and a gas nozzle F are provided on the top of the ignition base A. In addition, a housing cover (not shown) is also provided on the top of the ignition base, and the user can turn the horizontal bar of the gas nozzle F to start or stop the flame and to adjust the strength of the flame (i.e. the gas supply quantity). However, such conventional lighter structure often has the following defects:

(1) Between the ignition base and rod body only threads are used to join them together, and it is extremely easy for the consumers' incorrect use or neglect to cause them to get loose and therefore for one to slip off the other, which in turn causes gas leakage and even danger.

(2) The opening and closing of the supply valve and the adjustments of gas supply quantity must all be executed by turning the horizontal bar of the nozzle. Particularly, since the nozzle and adjustment horizontal bar are provided and located too close to each other, when the flame is present, it is very inconveneint to make adjustments of the gas supply quantity, because if and when the user wants to do so, his hand may easily get burned, so this is a potential danger.

(3) When the user places the housing cover back on the ignition base, he must turn the horizontal bar of the nozzle inwardly to close the nozzle so that the bar will no longer hamper the mounting of the housing cover, and similarly, during use, the user also has to turn said horizontal bar outwardly to open the nozzle to let the gas escape, so the lighter is quite inconvenient to use.

SUMMARY OF THE INVENTION

In view of the above described defects, the inventor has provided the design of the elongated rod-like lighter of this case, and its advantage lies in that the conventional adjustment horizontal bar is changed to a simple, convenient and safe gas adjustment ring to adjust the gas supply quantity and that a positioning ring is provided between the ignition base and rod body to join them tightly together internally and externally, thereby forming a fixed joint without any worry about gas leakage due to coming apart, and also maximizing the safety and practicability of the elongated rod-like lighter in use.

BRIEF DESCRIPTION OF THE PREFERRED EMBODIMENT

Figure 1:
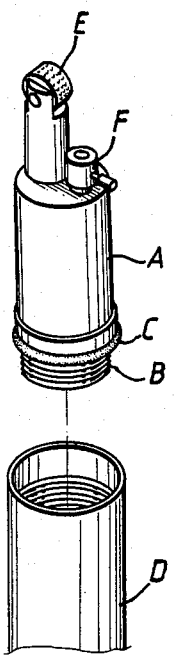
FIG. 1 is an exploded perspective view of the structure of a conventional elongated rod-like lighter.
Figure 2:
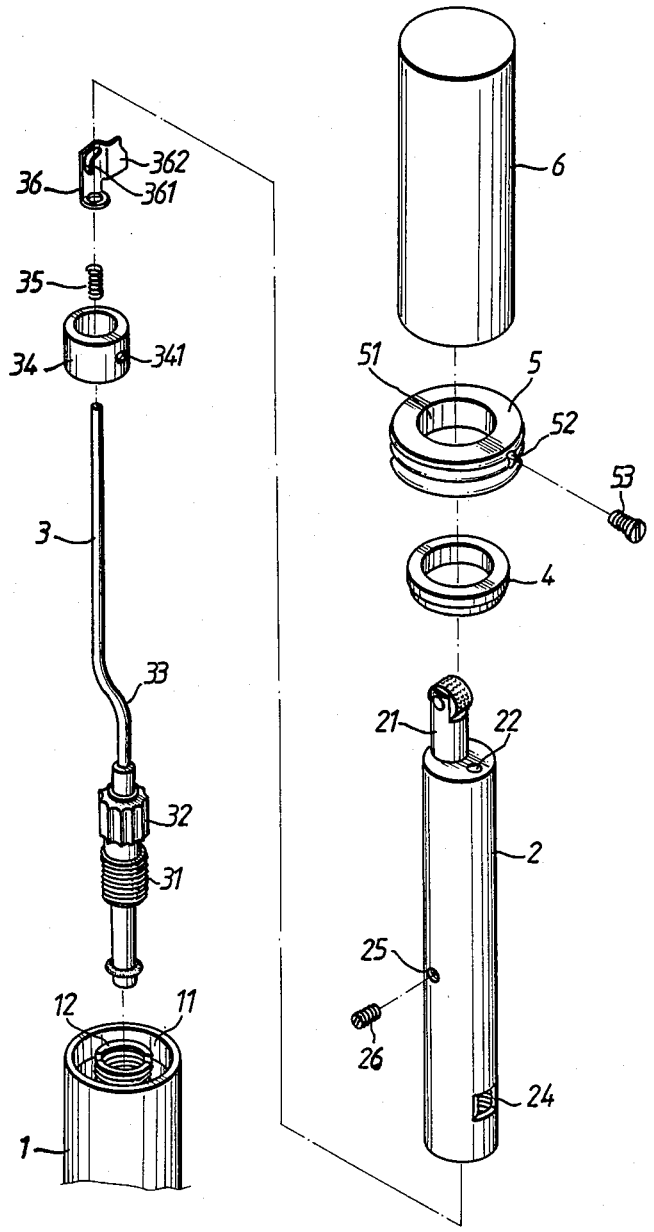
FIG. 2 is an exploded perspective view of the structure of a lighter according to the present invention.
Figure 3:
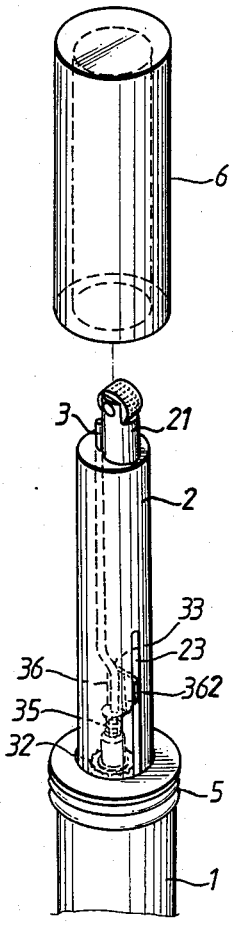
FIG. 3 is a perspective view of the assembled lighter according to the present invention with the cover removed.

As shown in FIG. 2, the main components of the elongated rod-like lighter according to the present invention are a rod body 1 for storing gas therein, an ignition base 2, a gas nozzle 3, a positioning ring 4, a gas adjusting ring 5, and a cover 6. The top of the body 1 has a concave annular rim 11, and a threaded gas outlet base is provided in the center of the annular ring 11 and has flange threads 12 on the outside and inside for receiving and positioning the ignition base 2 and gas nozzle tube 3.

The upper part of the ignition base 2 is solid and has two eccentric holes in the top, its lower half is hollow, and threads are provided on its bottom to engage with the flange threads 12 of the gas outlet base for positioning thereon. An ignition assembly support post 21 for an abrasive wheel is inserted into the larger eccentric hole in the top of the ignition base 2, and the gas nozzle 3 protrudes through the smaller hole and guides the nozzle tube 3 so that it maintains an upright position when the nozzle tube 3 moves up and down. An axial elongated groove 23 is provided in a side wall of the hollow lower half of the ignition base 2 and extends to the bottom, and a radial hole 24 is provided in the opposite side wall and is also located close to the bottom, and a fixing screw hole 25 is provided in the side wall of the middle section of the ignition base 2, the axial elongated groove 23, radial groove hole 24 and screw hole 25 all communicating with the hollow interior.

The top end of gas nozzle tube 3 protrudes from the smaller eccentric hole 22 in ignition base 2, and its bottom is movalbe up and down in threaded base 31, which in turn is threaded into the interior of the flange threads 12 of the gas outlet base of rod body 1 for positioning the nozzle. A fire-center screw 32 which serves as a gas flow adjusting valve is rotatably provided on the base 31, and the lower end of gas nozzle tube 3 has a bend 33 on which an adjustment telescopic tube 34, a spring 35 and valve support plate 36 are provided in sequence. The valve support plate 36 has an elongated arcuate through hole 361, and screw 26 passes through the screw hole 25 in the ignition base and through hole 361 of the valve support plate 36 to fix valve support plate 36 at a proper place. A flange 362 on valve support 36 protrudes slightly out of the axial elongated groove in the side wall of the ignition base 2, and when the housing cover 6 is placed on the ignition base 2, this drives the valve support plate 36 and nozzle tube 3 down to close off the gas supply, and conversely, when the housing cover 6 is removed therefrom, spring 35 will urge the valve support plate 36 and nozzle tube 3 up to permit gas to flow out of the nozzle tube 3 to expedite ignition.

The positioning ring 4 is made of brass and has an outside diameter slightly larger than the inside diameter of the annular rim 11 on the top of rod body 1 and an inside diameter slightly smaller than the outside diameter of the ignition base. When the ignition base 2 and rod boy 2 are screwed together tightly so as to be pressed together, a close fit is produced because of the relative softness of the brass material, so the ignition base 2 will not come loose and permit leakage and subsequent dnagers due to incorrect handling of the lighter.

Figure 4:
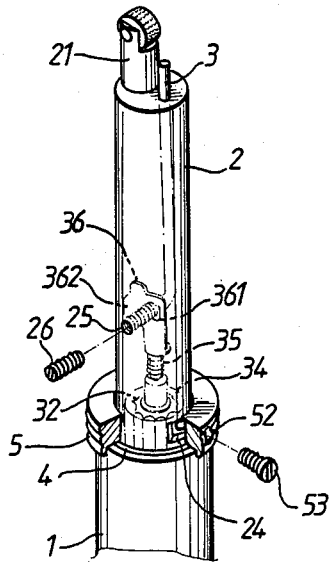
FIG. 4 is a partially cut away perspective view of the positioning ring structure according to the present invention.

The gas adjustment ring 5 has a central hole 51 into which the ignition base 2 is inserted as it is movably engaged with the top of rod body 1. A threaded radial hole 52 is provided on the circumference thereof through which a screw 53 extends into the circumferential groove hole 24 and the threaded hole 341 in the adjustment telescopic tube 34 and then against the fire-center screw 32 of the nozzle 3. When the gas adjustment ring 5 is rotated, the space provided by the circumferential groove hole 24 permits the screw 53 to be displaced circumferentially and to drive the fire-center screw 32 in rotation to adjust the quantity of gas supplied (as shown in FIG. 4).

A housing cover 6 covers the assembly formed by the ignition base 2 and rod body 1.

In the above described structure, when the housing cover 6 covers the ignition base 2, its lower edge exerts an axial downward pressing force against the flange 362 protruding outside of the base 2 through groove 23 to cause the valve support plate 36 to move downwardly and inwardly by the cooperation of elongated hole 361 with screw 26, which causes the nozzle tube 3 to be pressed downward a short distance, thereby closing off a flow hole in the base 31 to shut off the gas supply, i.e. when the housing cover 6 closes. When the housing cover 6 is removed therefrom, the compressed spring 35 urges the support plate 36 up, and the nozzle tube 3 also moves upward, thereby opening the gas flow hole for gas supply.

The gas adjustment ring 5 is located at thet op of rod body 1 and is at a distance from the upper end of gas nozzle tube 3 to conveniently and safely permit adjustment of the gas flow. When the housing cover 6 is placed on the lighter, the cover 6 just fits over the gas adjustment ring 5 to completely close the lighter without any adverse impact on its overall appearance and convenience of use.

What is claimed:

1. An elongated rod-like gas lighter, comprisng:

a rod body having an upper end and a lower end for storing gas therein;

an ignition base having a wall and on the upper end of said rod body, said ignition base having a circumferential grooveshaped hole through the wall of said ignition base thereof adjacent the point of attachment to said rod body;

a gas adjustment ring rottably mounted around said ignition base and movably engaged with the upper end of said rod body and having a threaded hole radially therethrough and a gas supply adjusting screw therein extending through said circumferential groove-shaped hole;

a gas nozzle tube within said ignition base having an upper end and a lower end, the upper end of the gas nozzle tube extending upwardly out of said ignition base; and a rotatably operable gas flow adjusting valve on the upper end of said rod body and receiving the lower end of said gas nozzle tube, said gas supply adjusting screw being engaged with an outer portion of said gas flow adjusting valve for rotating said gas flow adjusting valve when said gas adjusting ring is rotated on said ignition base.

2. A gas lighter as claimed in claim 1 further comprising an adjustment ring telescopically sleeved around the outer portion of said gas flow adjusting valve and rotatably positioned within said ignition base, and having a threaded radial hole therethrough through which said gas supply adjusting screw is threaded.

3. A gas lighter as claimed in claim 1 further comprising a positioning ring made of brass material having an outer diameter slightly larger than the inner diameter of the upper end of said rod body and an inner diameter slightly smaller than the outer diameter of said ignition base, said positioning ring being force fitted into the upper end of said rod body and having said ignition base force fitted into said positioning ring for firmly connecting said ignition base to said rod body.

* * * * *